US011128942B2

(12) United States Patent
Bottoni et al.

(10) Patent No.: US 11,128,942 B2
(45) Date of Patent: Sep. 21, 2021

(54) SOUND TRANSDUCER ARRANGEMENT HAVING A MEMS UNIT

(71) Applicant: USound GmbH, Graz (AT)

(72) Inventors: Ferruccio Bottoni, Graz (AT); Andrea Rusconi Clerici Beltrami, Vienna (AT)

(73) Assignee: USOUND GMBH, Graz (AT)

( * ) Notice: Subject to any disclaimer, the term of this patent is extended or adjusted under 35 U.S.C. 154(b) by 0 days.

(21) Appl. No.: 16/625,345

(22) PCT Filed: Jun. 8, 2018

(86) PCT No.: PCT/EP2018/065172
§ 371 (c)(1),
(2) Date: Dec. 20, 2019

(87) PCT Pub. No.: WO2019/001930
PCT Pub. Date: Jan. 3, 2019

(65) Prior Publication Data

US 2021/0067853 A1 Mar. 4, 2021

(30) Foreign Application Priority Data

Jun. 26, 2017 (DE) ..... 102017114142.1

(51) Int. Cl.
*H04R 1/04* (2006.01)
*H04R 17/02* (2006.01)
*H04R 31/00* (2006.01)

(52) U.S. Cl.
CPC ..... *H04R 1/04* (2013.01); *H04R 17/02* (2013.01); *H04R 31/006* (2013.01); *H04R 2201/003* (2013.01)

(58) Field of Classification Search
None
See application file for complete search history.

(56) References Cited

U.S. PATENT DOCUMENTS 10,425,741 B2 9/2019 Rusconi Clerici Beltrami et al.
10,433,063 B2 10/2019 Rusconi Clerici Beltrami et al.
(Continued)

FOREIGN PATENT DOCUMENTS

CN 103052011 A 4/2013
CN 104427456 A 3/2015
(Continued)

OTHER PUBLICATIONS

German Search Report and English Translation thereof, DE Patent Application No. 102017114142.1, dated Feb. 23, 2018, 18 pages.
(Continued)

*Primary Examiner* — Paul W Huber
(74) *Attorney, Agent, or Firm* — Dority & Manning, P.A.

(57) ABSTRACT

A sound transducer arrangement for generating and/or detecting sound waves in the audible wavelength spectrum includes an acoustic unit, which includes a vibratable diaphragm and a MEMS unit coupled to the diaphragm for generating and/or detecting a deflection of the diaphragm. The sound transducer arrangement includes a MEMS structure, which includes a support unit on which the MEMS unit and the acoustic unit are arranged. The support unit includes a metallic lead frame and a plastic body, with which the lead frame is partially circumferentially fused.

20 Claims, 6 Drawing Sheets

(56) References Cited

U.S. PATENT DOCUMENTS

| | | | | |
|---|---|---|---|---|
| 2009/0002961 | A1 | 1/2009 | Camacho et al. | |
| 2012/0212925 | A1 | 8/2012 | Zoellin et al. | |
| 2015/0001646 | A1* | 1/2015 | Mueller | B81C 1/0023 257/416 |
| 2018/0139543 | A1 | 5/2018 | Clerici et al. | |

FOREIGN PATENT DOCUMENTS

| | | |
|---|---|---|
| DE | 102011084393 | 4/2013 |
| DE | 102014108951 | 12/2014 |
| DE | 102015107560 | 11/2016 |
| DE | 102015116640 | 4/2017 |
| DE | 102015116707 | 4/2017 |

OTHER PUBLICATIONS

"Injection Moulding," Wikipedia, Wikimedia Foundation, en.wikipedia.org/wiki/injection_moulding, originally accessed Feb. 23, 2018, 15 pages.

International Search Report and Written Opinion of the Searching Authority and English Translation thereof, PCT Application No. PCT/EP2018/065172, 15 pages.

Chinese Office Action dated Oct. 29, 2020 and translation, 14 pages.

EPO Examination Report dated May 4, 2021 and English translation, 10 pages.

* cited by examiner

SOUND TRANSDUCER ARRANGEMENT HAVING A MEMS UNIT

CROSS REFERENCE TO OTHER APPLICATIONS

Field of the Invention

The present invention relates to a sound transducer arrangement for generating and/or detecting sound waves in the audible wavelength spectrum, comprising an acoustic unit, which includes a vibratable diaphragm, comprising a MEMS unit, which includes a MEMS structure, coupled to the diaphragm, for generating and/or detecting a deflection of the diaphragm, and comprising a support unit on which the MEMS unit and the acoustic unit are arranged.

Background of the Invention

A sound transducer arrangement comprising a first MEMS sound transducer for generating and/or detecting sound waves in the audible wavelength spectrum is known from DE 10 2015 107 560 A1, also published as US Patent Application Publication No. 2018-0139,543, which is hereby incorporated herein by this reference for all purposes. The MEMS sound transducer is arranged on a circuit board in this case. This is disadvantageous, since limits are set on the use of a circuit board as a support for the MEMS sound transducer with respect to stability, modular design of the sound transducer arrangement, and performance of the MEMS sound transducer.

OBJECTS AND SUMMARY OF THE INVENTION

The object of the present invention is therefore to eliminate the disadvantages of the related art.

The object is achieved by means of a sound transducer arrangement having the features described below.

The invention relates to a sound transducer arrangement for generating and/or detecting sound waves in the audible wavelength spectrum. The sound transducer arrangement comprises an acoustic unit, which includes a vibratable diaphragm.

Moreover, the sound transducer arrangement comprises a MEMS unit, which includes a MEMS structure, coupled to the diaphragm, for generating and/or detecting a deflection of the diaphragm. The abbreviation MEMS stands for microelectromechanical systems.

The deflection can be transmitted to the vibratable diaphragm. As a result, air situated above the diaphragm can be made to vibrate, so that the sound waves are generated. The sound transducer arrangement can therefore be designed as a loudspeaker.

Additionally or alternatively, the diaphragm can also be made to vibrate by the air situated thereover. These vibrations can be transmitted to the MEMS structure, so that the MEMS structure is deflected. As a result, the sound transducer arrangement can be designed as a microphone.

Furthermore, the sound transducer arrangement comprises a support unit, on which the MEMS unit and the acoustic unit are arranged.

According to the invention, the support unit comprises a metallic conductor frame and a plastic body, with which the conductor frame is partially circumferentially fused. The conductor frame, including the circumferentially fused plastic body, can be manufactured in large quantities at low cost.

The conductor frame can be, for example, relatively easily punched out of a metal sheet. Thereupon, the plastic body can be arranged around the conductor frame with the aid of an injection molding process. The liquid plastic surrounds the conductor frame. In so doing, the conductor frame can be circumferentially fused completely or only in some areas. An advantage thereof is that nearly any kind of structures can be formed on the conductor frame.

In an advantageous enhanced embodiment of the invention, the support unit includes a breakthrough. The breakthrough can preferably be arranged in a middle area of the support unit. The breakthrough is at least partially surrounded by a support area for accommodating the MEMS unit. The support area can advantageously be designed as a support frame. The MEMS unit can be placed onto the support area. For example, the MEMS unit can be placed onto the support area in such a way that the MEMS unit covers the breakthrough. The MEMS unit can completely cover the breakthrough. The MEMS unit can be arranged in the support area, for example, via an edge region. The MEMS unit can completely close the breakthrough. The advantage of the breakthrough is that the MEMS structure of the MEMS unit can deflect not only away from the support unit, but also into the breakthrough, toward the support unit. This deflection can take place along an axial direction toward the MEMS unit. Furthermore, the MEMS unit can be arranged in parallel to the support unit, so that the axial direction of the MEMS unit is oriented in parallel to an axial direction of the support unit.

Moreover, it is advantageous when the conductor frame comprises frame struts and frame openings located therebetween. As a result, the amount of metal utilized for the conductor frame can be reduced, so that the sound transducer arrangement is formed in a weight-saving manner.

The frame struts can extend outward from the support area in the form of rays. The frame struts can extend radially outward. The radial direction can be oriented in such a way that it is oriented perpendicularly to the axial direction. The radial direction can also extend transversely to the axial direction.

Moreover, the frame struts can be arranged in parallel to one another in a first area of the support unit. This first area can be arranged, for example, adjacent to the support area. The first area can also be arranged around the support area.

In a second area, arranged radially farther outward with respect to the first area, the frame struts can form an angle with respect to one another. In this second area, the frame struts can move apart from one another outward in the radial direction.

In a transition area between the first area and the second area, a least one portion of the frame struts can have a sharp bend.

Additionally or alternatively, the plastic body can fill at least one part of the frame openings between the frame struts. The plastic body can also completely fill the frame openings. A stability of the support unit can be enhanced as a result.

It is also advantageous when the support area is formed by the conductor frame. Additionally or alternatively, the support area can also be formed by the plastic body. Instead of the support area, the support frame can also be formed by the conductor frame. Additionally or alternatively, the support frame can also be formed by the plastic body. As a result, further elements for the support area or for the support frame can be dispensed with.

Furthermore, it is advantageous when the support area comprises at least one electrical contact area. Additionally or alternatively, the conductor frame can also comprise at least one electrical contact area. With the aid of the contact area, for example, electrical energy can be supplied for operating the MEMS unit. Additionally or alternatively, audio signals can also be conducted to the MEMS unit when the sound transducer arrangement is operated, for example, as a loudspeaker. Moreover, additionally or alternatively, the audio signals can also be conducted away from the MEMS unit when the sound transducer arrangement is operated, for example, as a microphone.

Advantageously, the support area and/or the conductor frame can also comprise multiple contact areas, so that multiple audio signals and/or other signals can be transmitted in parallel to the MEMS unit and/or in parallel away from the MEMS unit.

When the support area and/or the conductor frame have/has at least two contact areas, these can be electrically insulated from one another by the plastic body. As a result, the risk of a short circuit and associated damage to an electronics system of the sound transducer arrangement is reduced.

In a further advantageous enhanced embodiment of the invention, at least one contact area is electrically conductively connected to the conductor frame. Alternatively, the contact area can also be connected to at least one frame strut. When the support area, for example, the support frame, and/or the conductor frame comprise/comprises multiple contact areas, one particular contact area can also advantageously be electrically conductively connected to only one associated frame strut.

Furthermore, at least two contact areas can be electrically conductively connected to one another. When, for example, a reference potential (ground) is to be applied to these contact areas, the contact areas can be electrically conductively connected to one another for a potential equalization.

With the aid of the electrically conductive connection between a contact area and an associated frame strut, the conductor frame itself can be utilized as an electrical line. As a result, additional audio lines and/or energy lines can be dispensed with.

A connection to an external unit can also be established via the frame strut(s). The external unit can be, for example, a smartphone and/or a playback device.

Moreover, it is advantageous when the MEMS unit comprises at least one connection section for transmitting audio signals and/or electrical energy. The connection section can therefore be an interface, in order to conduct the audio signals and/or the electrical energy to the MEMS unit. Additionally or alternatively, the audio signals can also be conducted away from the MEMS unit, with the aid of the connection section, when the sound transducer arrangement is operated, for example, as a microphone.

In order to be able to conduct the audio signals to the MEMS unit or away from the MEMS unit, the connection section can be connected to the at least one contact area.

The connection section can be connected to the contact area, for example, with the aid of a soldered joint. Additionally or alternatively, an electrically conductive adhesive bond can also be formed between the connection section and the contact area.

With the aid of the connection section of the MEMS unit, the MEMS unit can be arranged on the support unit or in the support area, in particular on the support frame, in an easy way. The MEMS unit can be inserted into the support area, for example, with the aid of surface mounting. Thereupon, the connection section can coincide with the associated contact area. Thereafter, the electrically conductive connection, for example, the soldered joint, can be established between the connection section and the contact area. This method can also be easily and quickly carried out, of course, when multiple connection sections are arranged on the MEMS unit and, therefore, multiple contact areas are arranged on the support unit. As a result, a complex and error-prone wiring of the MEMS unit on the support unit is dispensed with.

It is also advantageous when the support unit comprises, in particular adjacent to the MEMS unit, an ASIC receptacle, in which an ASIC for controlling the sound transducer arrangement can be arranged.

It is advantageous when the ASIC receptacle has an electrical connection to the conductor frame. As a result, the ASIC can be supplied, for example, with electrical energy.

Additionally or alternatively, the ASIC receptacle can also have an electrical connection to at least one frame strut. For example, as a result, the audio signals can be conducted to an input of the ASIC via the at least one frame strut. As a result, no further data lines are required.

In addition, the ASIC can establish a connection to the external unit via the frame strut.

It is also advantageous when at least one first base element is arranged around the support area on a first side face of the support unit. The first base element can be designed, for example, to be annular. The first base element can therefore enclose the support area. Furthermore, the acoustic unit can be arranged on the first base element.

Additionally or alternatively, a first cavity can be formed between the acoustic unit and the support unit. For example, the MEMS structure deflects into the first cavity.

Moreover, it is advantageous when at least a second base element is arranged on a second side face positioned opposite the first base element. The second base element can be designed, for example, to be annular.

Furthermore, a cover element can be arranged on the second base element, so that a second cavity can be formed between the cover element and the support unit. The MEMS structure can also deflect into the second cavity.

Advantageously, the first and/or the second base element are/is also formed by the plastic body. The base elements can be manufactured in an easy way, for example, with the aid of the injection molding process. The base elements can therefore be formed as one piece with the plastic body.

In order to be able to equalize a pressure between the first and the second cavities, it is advantageous when the support unit comprises at least one equalizing breakthrough. Due to the vibrating diaphragm, at least the first cavity is reduced and enlarged in terms of volume. The resultant compression and expansion of the air contained in the first cavity results in a push and a pull on the diaphragm. The diaphragm is therefore prevented from vibrating freely. With the aid of the equalizing breakthrough, a larger volume, namely the volume of the first and the second cavities in this case, can be compressed and expanded, so that the push and the pull on the diaphragm are weakened. When the second cavity is not delimited by a cover element, the second cavity is open, so that the push and the pull on the diaphragm are even further reduced.

In an advantageous enhanced embodiment of the invention, at least a portion of the frame struts protrude outward beyond the first base element. Additionally or alternatively, at least a portion of the frame struts can also protrude outward beyond the second base element.

Advantageously, the frame struts can be connected to a housing in the area of their ends. The housing can be, for example, an in-ear receiver, which can be arranged in an ear canal of a user, as a hearing aid. The housing can also be a housing of a microphone and/or a loudspeaker, however. The protruding frame struts can therefore be utilized as fastening elements, with the aid of which the sound transducer arrangement can be arranged in the housing. Therefore, further fastening elements can be dispensed with.

Moreover, it is advantageous when the ends of at least one part of the frame struts are bent in the axial direction toward the side of the first side face. Additionally or alternatively, the ends of at least one part of the frame struts can be bent in the axial direction toward the side of the second side face. Preferably, all frame struts can be bent toward a side face. Due to the bending of the ends of the frame struts, a contact surface between the ends and an inner side of the housing can be enlarged. The ends can be bent in such a way that they are oriented in parallel to the inner side of the housing. Furthermore, the ends can be bent, for example, in an alternating manner. This means, an end is bent, for example, in the axial direction toward the first side face and the end adjacent thereto in the circumferential direction is bent in the axial direction toward the second side face. This is followed, in the circumferential direction, by another end, which is bent in the axial direction toward the first side face.

In order to form a secure connection between the ends and the housing, it is advantageous when at least a portion of the free ends of the frame struts are adhered to the housing. Additionally or alternatively, a part of the ends can be screwed together with the housing. In order to form a simple connection, the ends can be latched together with the housing. The housing can comprise receptacles, into which the ends can be inserted. The ends can be latched onto the housing with the aid of a detent element in the receptacles and/or at the ends.

BRIEF DESCRIPTION OF THE DRAWINGS

Further advantages of the invention are described in the following exemplary embodiments. Wherein.

DETAILED DESCRIPTION OF EXEMPLARY EMBODIMENTS

Figure 1:
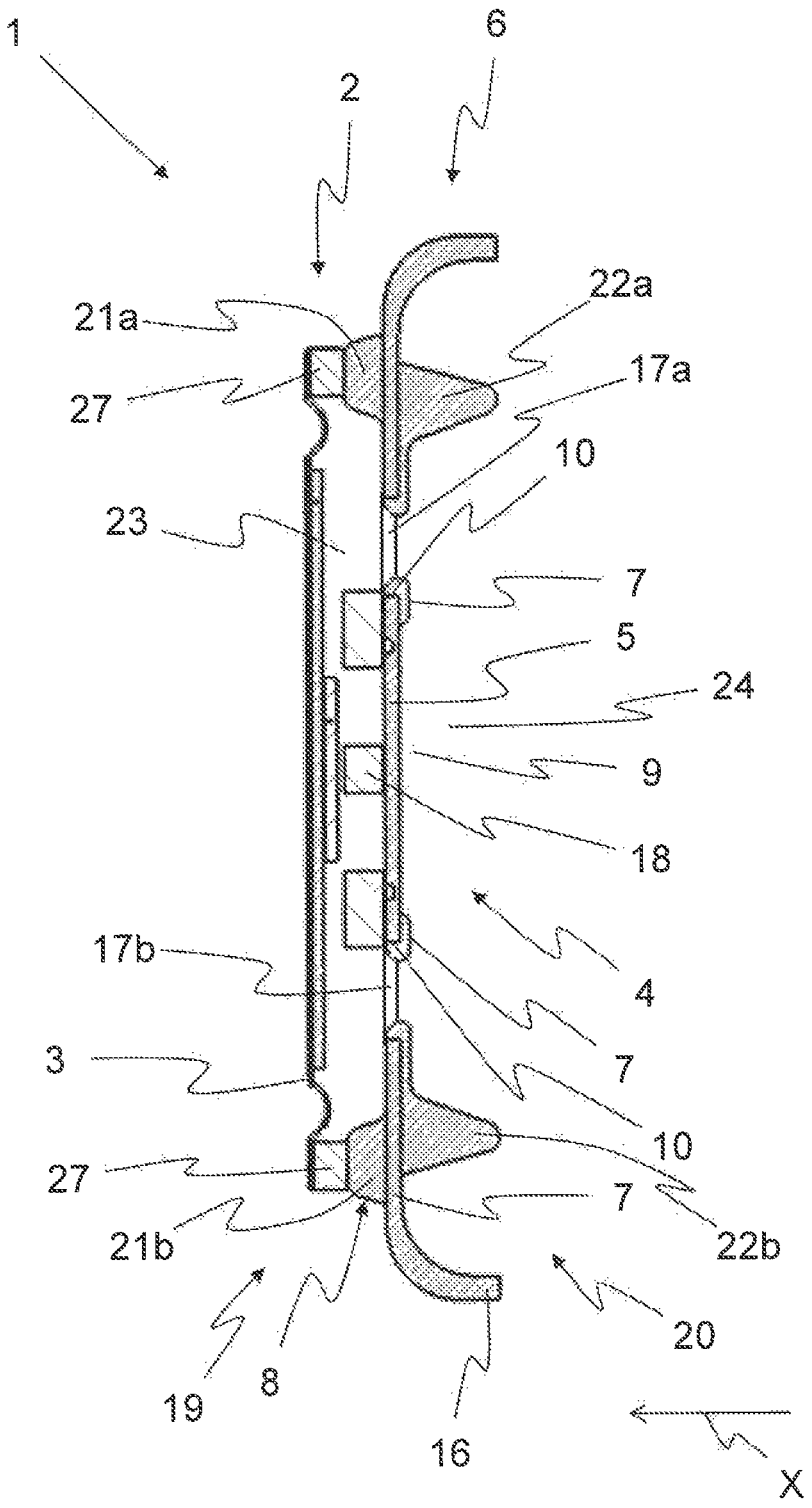
FIG. 1 shows a schematic sectional view of a sound transducer arrangement comprising an acoustic unit, a MEMS unit, and a support unit, taken in accordance with the exposed portions of these elements shown in FIG. 6.

FIG. 1 shows a schematic sectional view of a sound transducer arrangement 1. The sound transducer arrangement 1 comprises an acoustic unit 2, which includes a vibratable diaphragm 3. The diaphragm 3 can vibrate in an axial direction X. The diaphragm 3 can vibrate in both directions of the axial direction X. The diaphragm 3 can vibrate forward and rearward. With the aid of the diaphragm 3, sound waves can be generated when the diaphragm 3 is driven. Additionally or alternatively, sound waves can also be detected with the aid of the diaphragm 3. If the diaphragm 3 is subjected to sound waves, it begins to vibrate on its own and can relay the vibrations.

Moreover, the sound transducer arrangement 1 comprises a MEMS unit 4, which includes a MEMS structure 5. The MEMS structure 5 is coupled to the diaphragm 3. In order to couple the MEMS structure 5 to the diaphragm 3, the sound transducer arrangement in the present exemplary embodiment comprises a coupling element 18. With the aid of the MEMS structure 5, for example, deflections can be generated, which are transmitted onto the diaphragm 3. The MEMS structure 5 can convert, for example, electrical signals, which can encompass an audio signal, into the deflections. As a result of the deflection of the diaphragm 3, air situated above the diaphragm 3 can also be made to vibrate, and so the sound waves are formed. The sound transducer arrangement 1 can therefore be operated as a loudspeaker.

When sound waves are received with the aid of the diaphragm 3, the vibrating air causes the diaphragm 3 to vibrate. The vibrations can be transmitted, with the aid of the coupling element 18, from the diaphragm 3 onto the MEMS structure 5. The MEMS structure 5 can form electrical signals therefrom, which can correspond to an audio signal.

The MEMS structure 5 can comprise at least one piezoelectric element (not shown here), which undergoes the deflections when a voltage is applied. With the aid of the piezoelectric element, the deflection of the piezoelectric element can also be converted into a voltage. The voltage can correspond to the audio signal.

In addition, the sound transducer arrangement 1 comprises a support unit 6. The acoustic unit 2 and the MEMS unit 4 are arranged on the support unit 6.

The support unit 6 comprises a metallic conductor frame 7 and a plastic body 8. The conductor frame 7 is partially circumferentially fused with the plastic body 8. The support unit 6 can be made more stable with the aid of the conductor frame 7 and the plastic body 8. In addition, the metallic conductor frame 7 can be formed in a simple way, for example, with the aid of punching. In addition, the metallic conductor frame 7 can also be more simply designed when no high electro-technical requirements are placed thereon.

In addition, with the aid of the plastic body 8, for example, the acoustic unit 2 can be decoupled from the conductor frame 7 with respect to a transmission of undesirable vibrations when the acoustic unit 2 is arranged on the plastic body 8, as shown according to FIG. 1.

In an advantageous enhanced embodiment of the invention, the support unit 6 includes a breakthrough 9. The MEMS structure 5 can at least partially cover the breakthrough 9. The breakthrough 9 has the advantage that the MEMS structure 5 can freely vibrate into the breakthrough 9. The MEMS structure 5 can therefore vibrate freely in the axial direction X away from the diaphragm 3. The MEMS structure 5 pulls the diaphragm 3 along in this case. The coupling element 18 can also transmit a pulling force between the diaphragm 3 and the MEMS structure 5. The deflection of the MEMS structure 5 is therefore not impeded by a subsurface Furthermore, the breakthrough 9 can be bordered by a support area 10. The support area 10 can be designed as a support frame, which borders the breakthrough 9. The support area 10 can be formed by the conductor frame 7, as shown in FIG. 1. The MEMS unit 4 is advantageously arranged in the support area 10. The support area 10 supports the MEMS unit 4.

Furthermore, according to the present exemplary embodiment, at least one first base element 21*a*, 21*b* is arranged on a first side face 19 of the support unit 6. The at least one first base element 21*a*, 21*b* can be at least partially arranged around the support area 10. In the present exemplary embodiment, two first base elements 21*a*, 21*b* are arranged around the support area 10. The acoustic unit 2 is arranged on the at least one first base element 21*a*, 21*b*. The acoustic unit 2 can be adhesively bonded, for example, onto the at least one first base element 21*a*, 21*b*. As shown according to FIG. 1, the acoustic unit 2 can comprise an acoustic frame 27, onto which the diaphragm 3 has been clamped. In the present exemplary embodiment, the acoustic frame 27 is arranged on the at least one first base element 21*a*, 21*b*. The acoustic frame 27 can also be designed, for example, as a ring.

The at least one first base element 21*a*, 21*b* can be formed by the conductor frame 7. Additionally or alternatively, the at least one first base element 21*a*, 21*b* can be formed by the plastic body 8. In the present exemplary embodiment, the at least one first base element 21*a*, 21*b* is formed by the plastic body 8.

In addition, according to FIG. 1, at least one second base element 22*a*, 22*b* is arranged on a second side face 20 positioned opposite the first side face 19. The at least one second base element 22*a*, 22*b* can be at least partially arranged around the support area 10. In the present exemplary embodiment, two second base elements 22*a*, 22*b* are arranged around the support area 10. A cover element (not shown here) can be arranged on the at least one second base element 22*a*, 22*b*.

The cover element can be adhesively bonded, for example, onto the at least one second base element 22*a*, 22*b*. The at least one second base element 22*a*, 22*b* can be formed by the conductor frame 7. Additionally or alternatively, the at least one second base element 22*a*, 22*b* can be formed by the plastic body 8. In the present exemplary embodiment, the at least one second base element 22*a*, 22*b* is formed by the plastic body 8.

Furthermore, a first cavity 23 is formed between the acoustic unit 2 and the support unit 6. When the cover element is arranged on the at least one second base element 22*a*, 22*b*, a second cavity 24 is formed between the support unit 6 and the cover element.

At least one equalizing breakthrough 17 is arranged in the conductor frame 7 and/or in the plastic body 8. According to the present exemplary embodiment of FIG. 1, two equalizing breakthroughs 17*a*, 17*b* are provided. With the aid of the at least one equalizing breakthrough 17*a*, 17*b*, a pressure between the first cavity 23 and the second cavity 24 can be equalized. The pressure is formed when the diaphragm 3 vibrates and the volume of the first cavity 23 decreases and increases. As a result, the vibration of the diaphragm 3 is impeded and can, for example, corrupt the captured audio signal when the sound transducer arrangement 1 is operated as a microphone.

Figure 2:
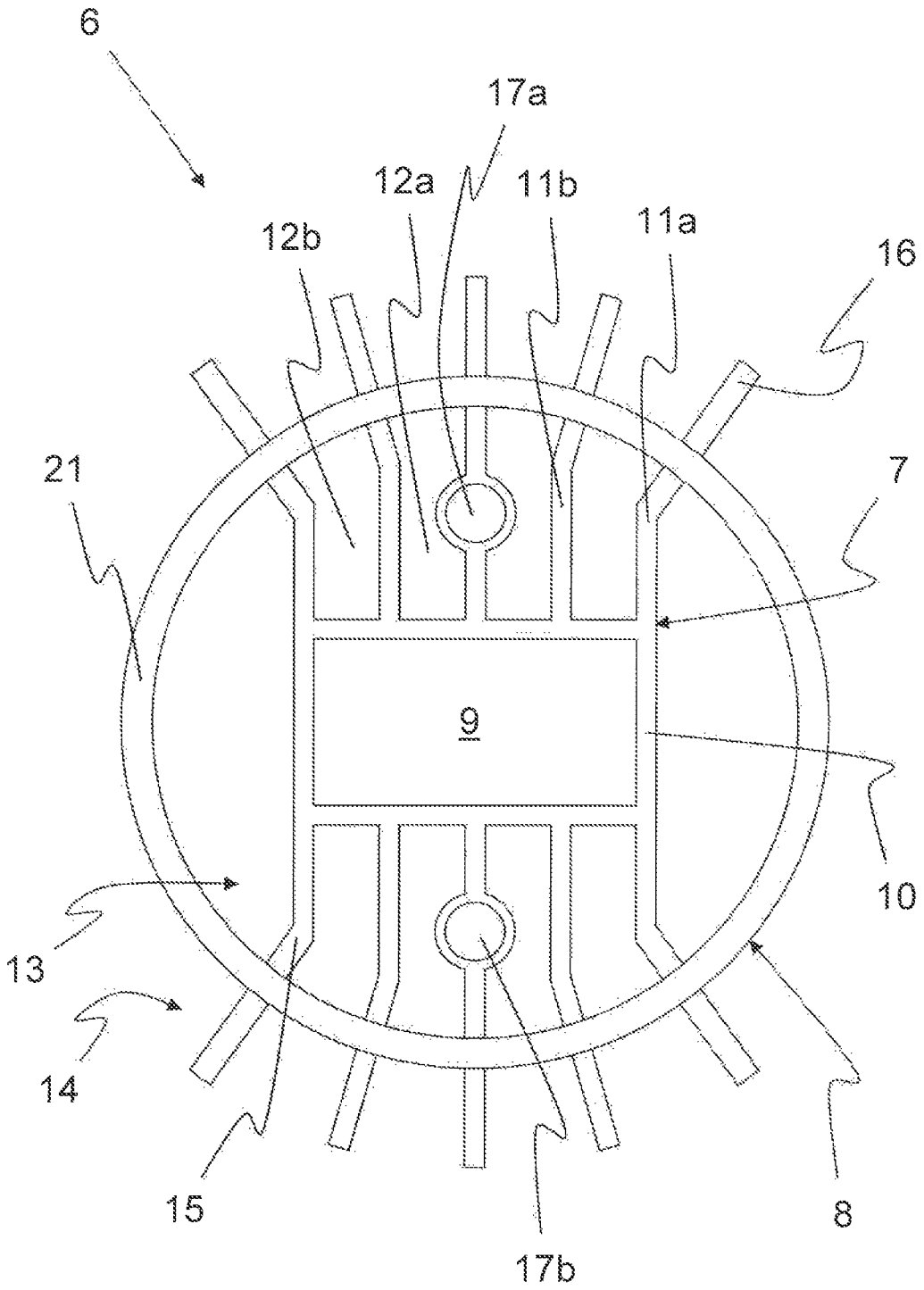
FIG. 2 shows a top view of a support unit comprising a lead frame and a plastic body.

FIG. 2 shows a top view of the metallic conductor frame 7 of the support unit 6 of the sound transducer arrangement 1. Moreover, the conductor frame 7 is partially circumferentially fused with the plastic body 8. In the top views shown in FIG. 2 and FIG. 3, the plastic body 8 is represented in a shaded manner for greater clarity. These are not necessarily sectional views.

In this exemplary embodiment, the support unit 6 is designed to be round. For this purpose, the conductor frame 7 is circumferentially fused with the plastic body 8 in such a way that the support unit 6 is designed to be round. The support unit 6 can also be designed to be angular, for example, rectangular, or elliptical. The support unit 6 can also comprise multiple areas, which are designed according to various, for example, aforementioned, shapes.

Furthermore, the support unit 6 comprises the breakthrough 9. The breakthrough 9 is an opening, which extends through the support unit 6. The breakthrough 9 is at least partially bordered by the support area 10. According to FIG. 2, the support area 10 completely borders the breakthrough 9. Furthermore, the support area 10 can be designed as a support frame. The support area 10 can preferably be at least partially formed by the conductor frame 7. Additionally or alternatively, the support area 10 can also be formed by the plastic body 8, however. Moreover, the MEMS unit 4 of the sound transducer arrangement 1 can be arranged in the support area 10. The MEMS unit 4 can completely cover the breakthrough 9. For this purpose, the breakthrough 9 can be designed with respect to dimensions, for example, in such a way that it corresponds to the size of the MEMS unit 4. The MEMS unit 4 can be arranged, for example, via its edge areas, in the support area 10.

In this exemplary embodiment, the conductor frame 7 comprises frame struts 11*a*, 11*b* and frame openings 12*a*, 12*b* located therebetween. For the sake of simplicity, only two frame struts 11*a*, 11*b* and two frame openings 12*a*, 12*b* are provided with a reference number, by way of example.

According to FIG. 2, the frame struts 11 extend outward in the form of rays. In the exemplary embodiment shown here, the frame struts 11 extend outward from the breakthrough 9. Furthermore, the frame struts 11 can extend outward away from the support area 10.

The frame struts 11 comprise at least one portion, which extends radially outward. The frame struts 11 therefore extend outward in a radial direction. The radial direction is perpendicular to the axial direction X of the support unit 6. In the present FIG. 2, the axial direction X extends perpendicularly into the plane of the drawing.

In a first area 13, the frame struts 11 can extend outward in parallel to one another. The frame struts 11 extend radially outward in a portion in the first area 13.

In a second area 14, arranged radially farther outward with respect to the first area 13, the frame struts 11 form an angle with respect to one another. The frame struts 11 extend apart from one another in the second area 14.

According to FIG. 2, a sharp bend 15 is arranged in the frame struts 11 between the first area 13 and the second area 14. For the sake of simplicity, only one sharp bend of a frame strut 11 is provided with a reference number.

Furthermore, in this exemplary embodiment, the frame struts 11 comprise free ends 16 extending beyond the plastic body 8. Only one free end 16 is provided with a reference number, for the sake of simplicity in this case as well.

The free ends 16 can be bent. The bent free ends 16 are shown in FIG. 1. According to FIG. 1, the free ends 16 are bent in the axial direction X toward the second side face 20 of the support unit 6. Alternatively, the free ends 16 can also be bent in the axial direction X toward the first side face 19. Alternatively, once again, a part of the free ends 16 can also be bent toward the first side face 19 and another portion of the free ends 16 can be bent toward the second side face 20. With the aid of the bent ends 16 of the frame struts 11, the sound transducer arrangement 1 can be arranged, for example, in a housing 28 (not shown here) (cf. FIG. 6). The bent free ends 16 can enlarge a contact surface between the frame struts 11 and the housing 28, so that the sound transducer arrangement 1 can be better fastened in the housing 28.

In the present exemplary embodiment, the support unit 6 comprises at least one equalizing breakthrough 17*a,* 17*b*. According to FIG. 2, the support unit 6 comprises two equalizing breakthroughs 17*a*, 17*b*. With the aid of the at least one equalizing breakthrough 17*a,* 17*b,* a pressure between the first cavity 23 and the second cavity 24 can be equalized (cf. FIG. 1).

Moreover, the at least one first base element 21 is shown in the exemplary embodiment of FIG. 2. In this case, only a single base element 21 is arranged on the support unit 6. In addition, the first base element 21 is designed to be annular. The free ends 16 of the frame struts 11 extend radially outward beyond the base element 21.

Additionally or alternatively, the at least one second base element 22 can also be designed to be annular.

Figure 3:
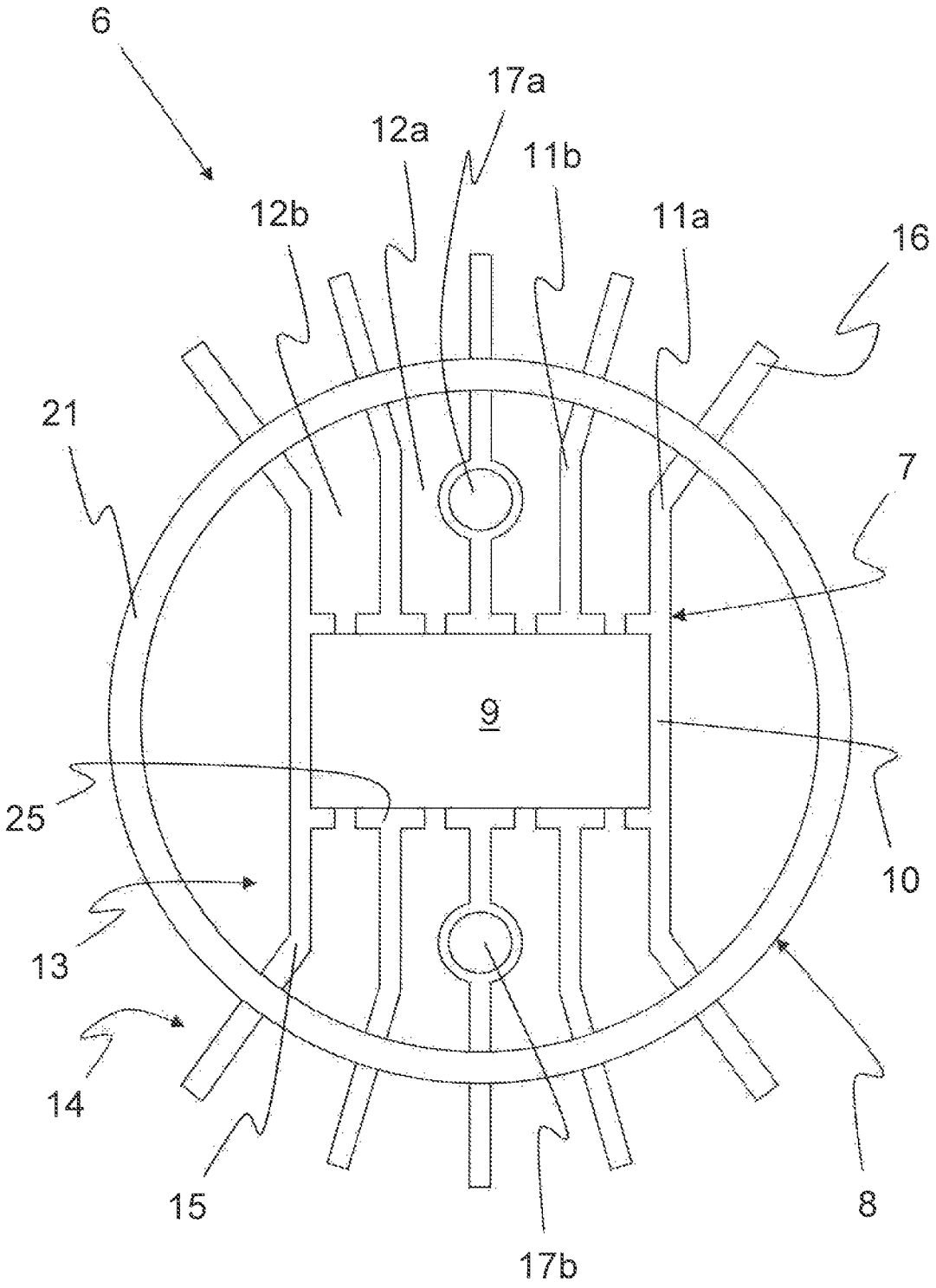
FIG. 3 shows a top view of a support unit comprising a lead frame and a plastic body in an alternative exemplary embodiment.

FIG. 3 shows a top view of a support unit 6 comprising a conductor frame 7 and a plastic body 8 in an alternative exemplary embodiment. In this exemplary embodiment, the support area 10, which can be designed as a support frame, comprises at least one electrically conductive contact area 25. The contact area 25 is also part of the conductor frame 7. For the sake of simplicity, only one contact area 25 is provided with a reference number in this exemplary embodiment.

In this case, each set of two contact areas 25 is interrupted by the plastic body 8. Two contact areas 25 are electrically insulated from one another with the aid of the plastic body 8. With the aid of the contact areas 25, electrical signals, in particular audio signals, can be conducted to the MEMS unit 4 and/or away from the MEMS unit 4. When the MEMS unit 4 is arranged in the support area 10, at least one edge area of the MEMS unit 4 lies over the contact areas 25. With the aid of corresponding connection sections 26 (cf. FIG. 5) of the MEMS unit 4, in particular in the edge region, an electrical connection from the MEMS unit 4 to the contact areas 25 can be established via the connection sections 26. The corresponding connection sections 26 are located in the contact areas 25. Furthermore, the MEMS unit 4 can be arranged in the support area 10 with the aid of a soldered joint and/or an electrically conductive adhesive bond. Additionally or alternatively, the soldered joint and/or the electrically conductive adhesive bond can also connect the MEMS unit 4, in particular the connection sections 26, to the corresponding contact areas 25.

It is also advantageous when the particular contact areas 25 are each electrically conductively connected to a frame strut 11, as shown in the exemplary embodiment of FIG. 3. As a result, the electrical signals, in particular the audio signals and/or electrical energy, can be conducted via the frame struts 11 to the MEMS unit 4 and/or away from the MEMS unit 4. As a result, additional lines can be dispensed with.

Figure 4:
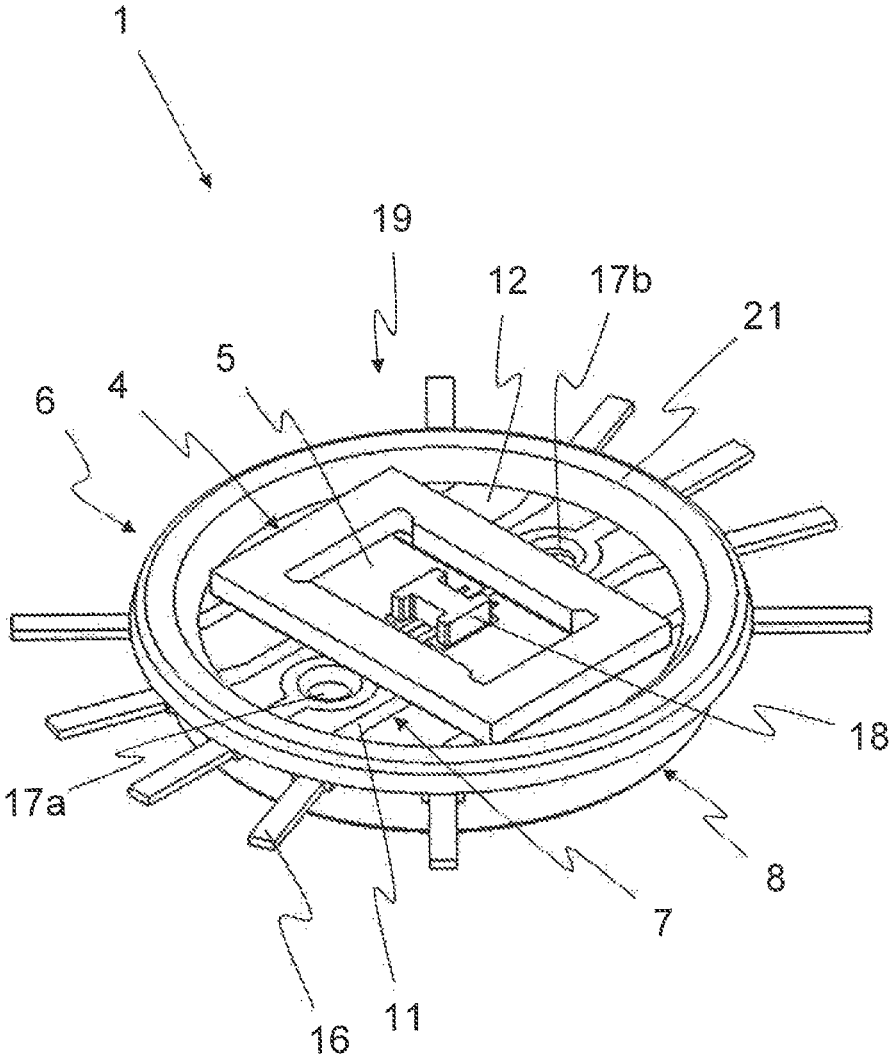
FIG. 4 shows a perspective top view of a portion of the sound transducer arrangement.

FIG. 4 shows a perspective top view of a part of the sound transducer arrangement 1. The top view corresponds to a view of the first side face 19 of the support unit 6.

The MEMS unit 4, which includes the MEMS structure 5, is arranged in the support area 10, which is covered in this case. The coupling element 18 is arranged on the MEMS structure 5, in order to connect the MEMS structure 5 to the diaphragm 3 (not shown here).

The sound transducer arrangement 1 comprises, on the support unit 6, the first base element 21, which, in this exemplary embodiment, is designed to be annular and extends around the support area 10. The acoustic unit 2, including the diaphragm, can be arranged on the first base element 21.

Figure 5:
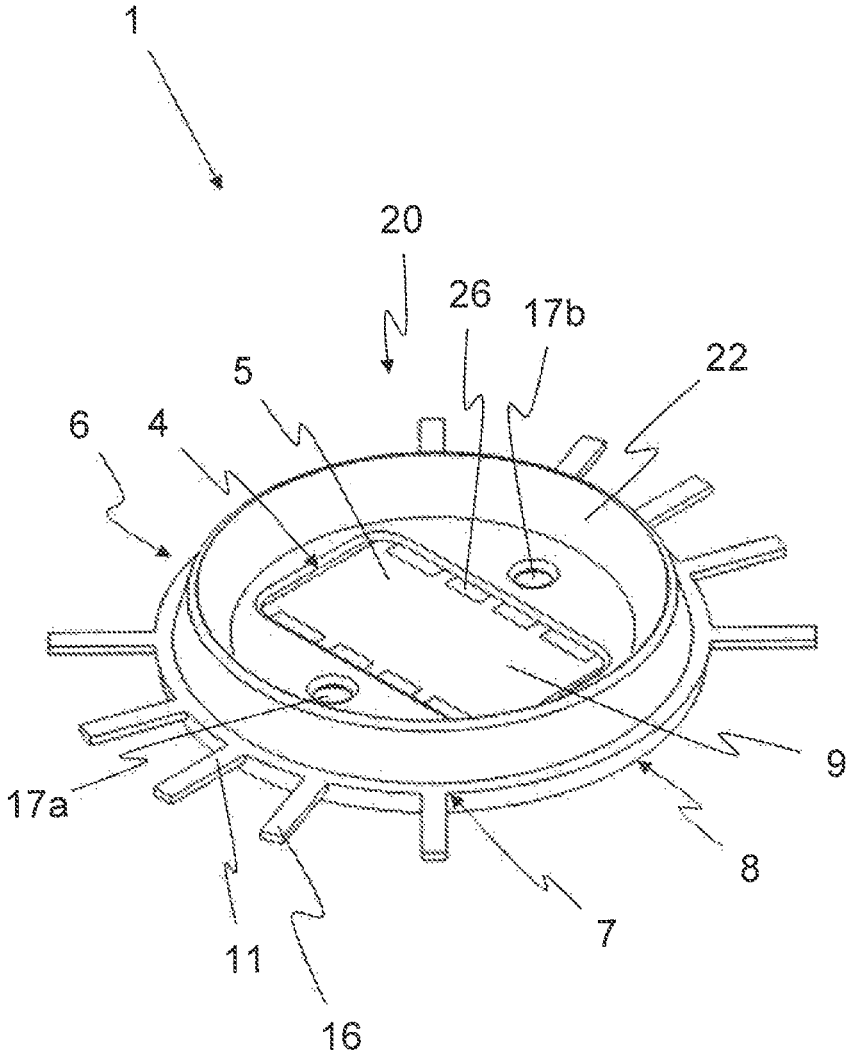
FIG. 5 shows a perspective back view of a portion of the sound transducer arrangement.

FIG. 5 shows a perspective back view of a part of the sound transducer arrangement 1. The view in this case is of the second side face 20 of the support unit 6. In the back view, the MEMS structure 5 of the MEMS unit 4 can be seen through the breakthrough 9. In this exemplary embodiment, the MEMS unit 4 comprises at least one connection section 26. For the sake of simplicity, once again, only a single connection section 26 is provided with a reference number. An electrical connection to the contact areas 25 of FIG. 3 can be established with the aid of the connection sections 26. As a result, electrical signals, in particular audio signals and/or electrical energy, can be conducted via the frame struts 11 to the MEMS unit 4 and/or away from the MEMS unit 4.

Moreover, the support unit 6 comprises the second base element 22. The second base element 22 is designed to be annular in this case. Furthermore, the second base element 22 surrounds the breakthrough 9. A cover element can be arranged on the second base element 22.

Figure 6:
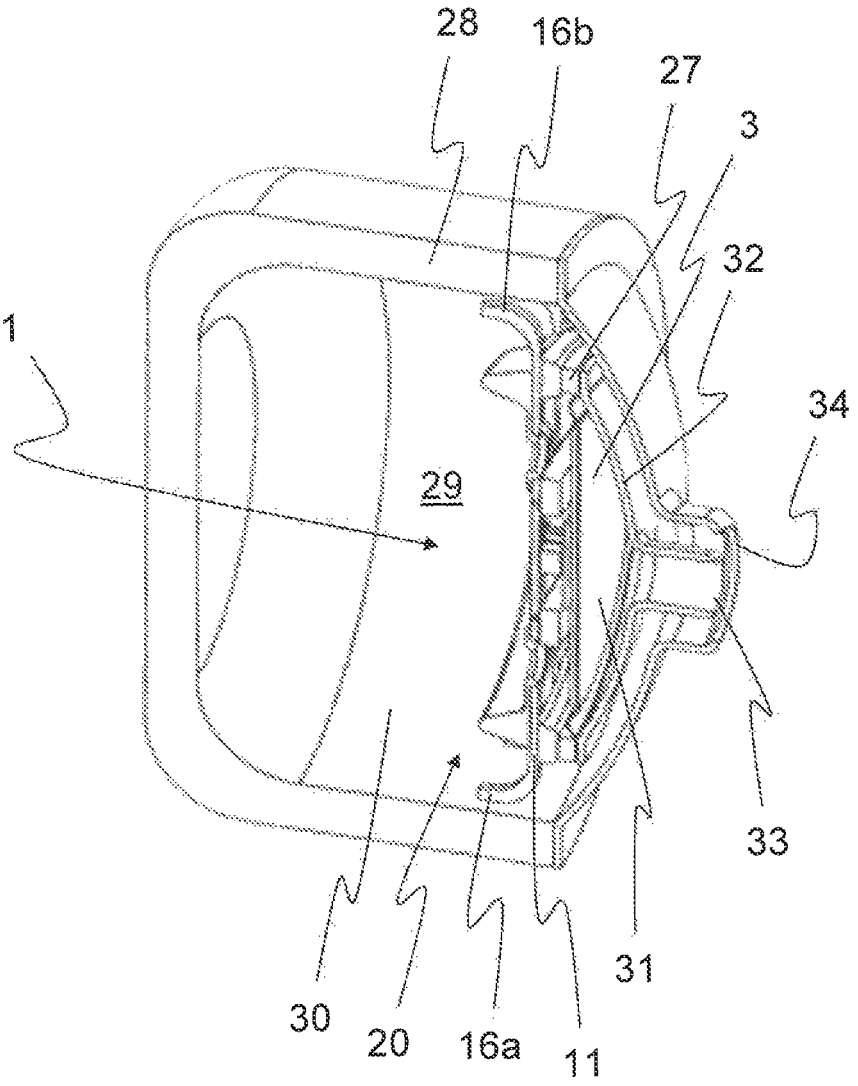
FIG. 6 shows a perspective sectional view of the sound transducer arrangement in a housing.

FIG. 6 shows a housing 28 comprising the sound transducer arrangement 1 arranged therein. In this exemplary embodiment, the sound transducer arrangement 1 comprises frame struts 11, wherein only one frame strut 11 is shown. The frame struts 11 comprise the ends 16*a*, 16*b,* with the aid of which the sound transducer arrangement 1 is connected to the housing 28. The ends 16*a,* 16*b* are bent, so that a contact surface between the ends 16*a,* 16*b* and the housing 28 enlarges. The ends 16 can be, for example, adhered, screwed, and/or latched together with the housing 28. As a result, the sound transducer arrangement 1 can be arranged in the housing 28 in a more stable manner.

Moreover, the sound transducer arrangement 1 delimits a resonant cavity 29 in the housing 28, so that a part of the resonant cavity 29 forms a back volume 30. The back volume 30 is arranged on the side of the second side face 20 of the sound transducer arrangement 1. The back volume 30 can be adapted with respect to size in a simple way when, for example, the sound transducer arrangement 1 is arranged farther in the direction of a middle area of the housing 28. Consequently, the back volume 30 is designed to be smaller as compared to the back volume 30 shown in FIG. 6. As a result, resonance properties of the back volume 30 can be adapted.

According to the present exemplary embodiment of FIG. 6, the sound transducer arrangement 1 comprises a coupling element 32. The coupling element 32 is arranged on the acoustic frame 27. A front volume 31 is formed between the diaphragm 3 and the coupling element 32. The shape of the front volume 31 can be adapted according to a shape of the coupling element 32. If the coupling element 32 is curved, for example, farther away from the diaphragm 3, the front volume 31 enlarges. As a result, the resonance properties of the front volume 31 can be adapted.

Furthermore, the coupling element 32 arranged on the sound transducer arrangement 1 in this exemplary embodiment of FIG. 6 comprises a first exit opening 33. The sound generated by the diaphragm 3 can exit through the first exit opening 33. Additionally or alternatively, the sound can also reach the diaphragm 3 through the first exit opening 33 when the sound is detected.

Moreover, the housing 28 comprises a second exit opening 34. The sound generated by the sound transducer arrangement 1 can exit the housing 28 through the second exit opening 34. Additionally or alternatively, the sound can also enter through the second exit opening when the sound is detected by the sound transducer arrangement 1.

The present invention is not limited to the represented and described exemplary embodiments. Modifications within the scope of the claims are also possible, as is any combination of the features, even if they are represented and described in different exemplary embodiments.

LIST OF REFERENCE NUMBERS

1 sound transducer arrangement
2 acoustic unit
3 diaphragm
4 MEMS unit
5 MEMS structure
6 support unit
7 conductor frame
8 plastic body
9 breakthrough
10 support area
11 frame strut
12 frame opening
13 first area
14 second area
15 sharp bend
16 free end
17 equalizing breakthrough
18 coupling element
19 first side face
20 second side face
21 first base element
22 second base element
23 first cavity
24 second cavity
25 contact area
26 connection section
27 acoustic frame
28 housing
29 resonant cavity
30 back volume
31 front volume
32 coupling element
33 first exit opening
34 second exit opening
X axial direction

The invention claimed is:

1. A sound transducer arrangement for generating and/or detecting sound waves in the audible wavelength spectrum, the sound transducer arrangement comprising:
an acoustic unit, which includes a vibratable diaphragm;
a MEMS unit, which includes a coupling element and a MEMS structure, which is coupled to the diaphragm by the coupling element for generating and/or detecting a deflection of the diaphragm; and
a support unit that includes a metallic conductor frame and a plastic body with which the conductor frame is partially circumferentially fused; and
wherein the acoustic unit is arranged on the plastic body and the MEMS unit is arranged on the metallic conductor frame.

2. The sound transducer arrangement as claimed in claim 1, wherein a middle region of the support unit defines a breakthrough, which is at least partially bordered by a support frame configured for accommodating the MEMS unit.

3. The sound transducer arrangement as claimed in claim 1, further comprising a support frame defining an annular base element that defines a center thereof, wherein the conductor frame comprises a plurality of frame struts and frame openings located therebetween, wherein each of the frame struts extends radially outwardly from the center of the annular base element of the support frame in the form of rays.

4. The sound transducer arrangement as claimed in claim 2, wherein the support frame is formed by the conductor frame and/or the plastic body.

5. The sound transducer arrangement as claimed in claim 3, wherein the support frame and/or the conductor frame includes an electrical contact area that is electrically conductively connected to the conductor frame or to at least one frame strut.

6. The sound transducer arrangement as claimed in claim 5, wherein the MEMS unit comprises at least one connection section for transmitting audio signals and/or electrical energy, which connection section is electrically connected to the contact area with the aid of a soldered joint and/or an electrically conductive adhesive bond.

7. The sound transducer arrangement as claimed in claim 1, wherein the support unit comprises an ASIC receptacle, which is configured for accommodating an ASIC for controlling the sound transducer arrangement, and/or wherein the ASIC receptacle comprises an electrical connection to the conductor frame so that the audio signals and/or the electrical energy can be exchanged between the ASIC and the MEMS unit and/or between the ASIC and an external unit.

8. A sound transducer arrangement for generating and/or detecting sound waves in the audible wavelength spectrum, the sound transducer arrangement comprising:
an acoustic unit, which includes a vibratable diaphragm;
a MEMS unit, which includes a MEMS structure coupled to the diaphragm for generating and/or detecting a deflection of the diaphragm; and
a support unit on which the MEMS unit and the acoustic unit are arranged, wherein the support unit comprises a metallic conductor frame and a plastic body with which the conductor frame is partially circumferentially fused;
wherein a middle region of the support unit defines a breakthrough, which is at least partially bordered by a support frame configured for accommodating the MEMS unit; and
wherein an annular first base element is arranged around the support frame on a first side face of the support unit, wherein the acoustic unit is arranged on the first base element, and wherein a first cavity is formed between the acoustic unit and the support unit.

9. The sound transducer arrangement as claimed in claim 8, wherein an annular second base element is arranged around the support frame on a second side face positioned opposite the first base element, and/or in a cover element that is arranged on the second base element, so that a second cavity is formed between the cover element and the support unit.

10. The sound transducer arrangement as claimed in claim 9, wherein the first base element and/or the second base element are/is formed by the plastic body.

11. The sound transducer arrangement as claimed in claim 10, wherein the support unit comprises at least one equalizing breakthrough, with the aid of which a pressure between the first cavity and the second cavity can be equalized.

12. The sound transducer arrangement as claimed in claim 8, wherein the support frame includes a plurality of frame struts and wherein at least a portion of each of the frame struts protrudes radially outward beyond the first base element and/or are connected to a housing in the area of their ends.

13. The sound transducer arrangement as claimed in claim 9, wherein and end of a frame strut is bent in the axial direction (X) toward the side of the first side face and/or the second side face.

14. The sound transducer arrangement as claimed in claim 3, further comprising a housing, wherein at least a portion of an end of a frame strut is adhered, screwed, and/or latched together with the housing.

15. The sound transducer arrangement as claimed in claim 1, wherein the conductor frame includes frame struts and frame openings located therebetween, and wherein the plastic body fills at least a portion of the frame openings between the frame struts.

16. The sound transducer arrangement as claimed claim 3, wherein the plastic body fills at least a portion of the frame openings between the frame struts.

17. The sound transducer arrangement as claimed in claim 3, wherein the support frame and/or the conductor frame includes two contact areas separated from one another in an electrically insulating manner by the plastic body and electrically conductively connected to the conductor frame or to at least one frame strut.

18. The sound transducer arrangement as claimed in claim 3, wherein the support unit includes an ASIC receptacle, which is configured for accommodating an ASIC for controlling the sound transducer arrangement, wherein the ASIC receptacle includes an electrical connection to at least one frame strut so that the audio signals and/or the electrical energy can be exchanged between the ASIC and the MEMS unit and/or between the ASIC and an external unit.

19. The sound transducer arrangement as claimed in claim 9, wherein the support frame includes a plurality of frame struts and wherein at least a portion of each of the frame struts protrudes radially outward beyond the second base element and/or are connected to a housing in the area of their ends.

20. A sound transducer arrangement for generating and/or detecting sound waves in the audible wavelength spectrum, the sound transducer arrangement comprising:

an acoustic frame;

a vibratable diaphragm clamped to the acoustic frame;

a MEMS unit, which includes a coupling element and a MEMS structure, which is coupled to the diaphragm by the coupling element for generating and/or detecting a deflection of the diaphragm; and a support unit that includes a metallic conductor frame and a plastic body with which the conductor frame is partially circumferentially fused; and wherein the acustic frame is arranged on the plastic body and the MEMS unit is arranged on the metallic conductor frame.

* * * * *